United States Patent [19]

Tong

[11] Patent Number: 4,713,037

[45] Date of Patent: Dec. 15, 1987

[54] SWIMMING MARINE CREATURE TOYS

[75] Inventor: Duncan Tong, Hong Kong, Hong Kong

[73] Assignee: Duncan Products Ltd., Hong Kong, Hong Kong

[21] Appl. No.: 894,991

[22] Filed: Aug. 8, 1986

[30] Foreign Application Priority Data

Sep. 10, 1985 [GB] United Kingdom ..... 8522372
Dec. 31, 1985 [GB] United Kingdom ..... 8531942

[51] Int. Cl.[4] ..... A63H 23/10
[52] U.S. Cl. ..... 446/158; 446/156
[58] Field of Search ..... 446/158, 157, 156, 161, 446/162, 163, 164

[56] References Cited

U.S. PATENT DOCUMENTS

| | | | |
|---|---|---|---|
| 2,229,175 | 1/1941 | Johnson | 446/158 |
| 2,611,996 | 9/1952 | Garelick | 446/158 |
| 3,153,879 | 10/1964 | Lucas | 446/158 |
| 3,656,586 | 4/1972 | Robson | 446/158 |
| 3,808,734 | 5/1974 | Suzuki | 446/158 |
| 4,135,326 | 1/1979 | Tong | 446/158 |
| 4,536,985 | 8/1985 | Caviness | 446/158 |
| 4,581,841 | 4/1986 | Gish | 446/156 |

*Primary Examiner*—Victor N. Sakran
*Attorney, Agent, or Firm*—Townsend & Townsend

[57] ABSTRACT

A toy is provided which simulates a marine creature. The toy comprises a body portion and a tail portion with a tail fin pivotally mounted thereto; a battery operated motor housed in a water-tight compartment in the body portion to move the tail and the tail fin relative to the body portion to propel the toy through the water; a drive to drive the tail portion comprising a pair of parallel cranks mounted opposite one another on a single spindle and driven through gearing by the motor; and a drive member extending down within the top portion of the tail, the drive member being provided with a pair of slots, each slot receiving a pin connected to one of the cranks. Buoyancy may be achieved using floats located in the body and tail portions.

6 Claims, 4 Drawing Figures

SWIMMING MARINE CREATURE TOYS

The present invention relates to toys and in particular to a toy which simulates a marine creature having a tail, such as a dolphin, whale or mermaid.

BRIEF SUMMARY OF THE INVENTION

Accordingly, the present invention provides a toy simulating a marine creature which comprises a body portion and a tail portion with a tail fin pivotally mounted thereto, a battery operated motor housed in the body portion and arranged to move the tail and the tail fin relative to the body portion to propel the toy through the water, a drive to drive the tail portion comprising a pair of parallel cranks mounted opposite one another on a single spindle and driven through gearing by the motor; and a drive member extending down within the top portion of the tail, the drive member being provided with a pair of slots, each slot receiving a pin connected to one of the cranks.

The tail portion may be attached to the body portion in such a way that water can flow either through an inlet or inlets near the head of the body, round the motor and the battery chamber and out through a gap between the body and the tail or through the gap between the body and the tail round the motor and the battery chamber and out through the same gap between the body and the tail. Preferably both the motor and the batteries are housed in water-tight compartments.

Preferably the tail oscillates up and down with respect to the body portion. The oscillation of the tail causes the tail fin to move in the opposite direction to the tail.

Preferably there are provided "floats", housed within the body portion and the tail portion. The floats are made of, for example, expanded polystyrene and are provided, as their name implies, to permit the toy to float and not to sink when it is placed and swims in water.

BRIEF DESCRIPTION OF THE DRAWINGS

The invention will now be described by way of example with reference to the accompany drawings, in which.

DESCRIPTION OF THE PREFER EMBODIMENTS

Figure 1:
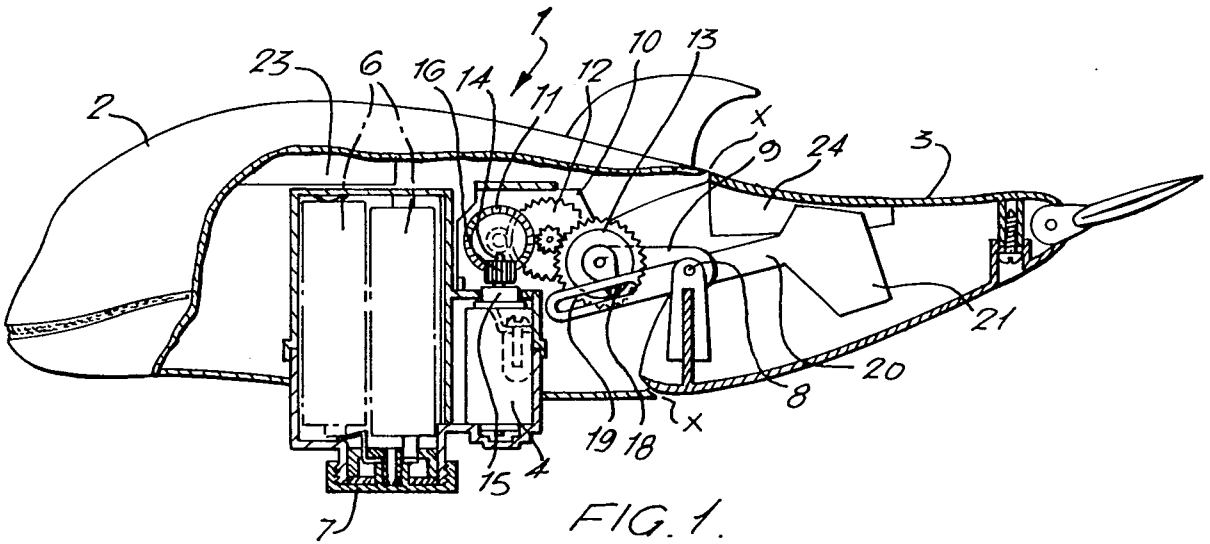
FIG. 1 is a partial vertical cross section through one embodiment of a toy whale in accordance with the present invention.
Figure 2:
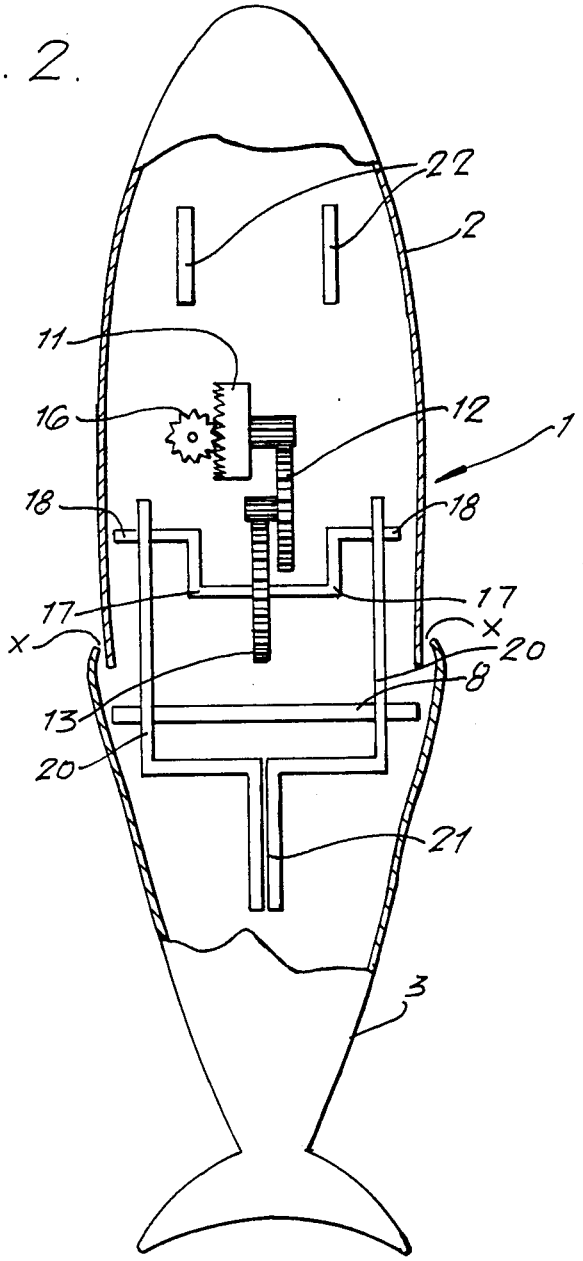
FIG. 2 is a partial plan view showing in particular the drive mechanism of the toy of FIG. 1.

The toy shown generally as 1 in FIGS. 1 and 2 simulates a whale and comprises a body portion 2 and a tail portion 3. A motor 4 is housed within a water-tight compartment 5 within the body 2 and is powered by batteries 6 housed in the battery compartment next to the motor compartment and connected to the motor by a rotatable on/off switch 7 which can be operated from outside the body 2 and make the battery compartment water-tight when the switch is turned to the on position.

The tail 3 is pivotally mounted at 8 to an extension 9 of an internal wall 10 of the body portion 1 constituting a gear box.

The tail 3 is driven by the motor 4 through a drive mechanism comprising three gear wheels 11, 12 and 13 mounted in the gear box 10. The gear 11 is driven by a shaft 14 of the motor 4 which extends through a water-tight opening 15 in the wall of the water-tight compartment 5. The shaft 14 carries a pinion gear 16 which engages gear wheel 11. Gear 11 engages gear 12 which in turn engages gear 13. The spindle of gear 13 carries two crank levers 17. Each crank lever 17 has a pin 18 which engages in a slot 19 located in respective extensions 20 of a drive member 21 which is located in the tail 3. The extensions 20 are also pivoted to the pivot 8.

When the motor 4 is run, the crank levers 17 rotate and the pins 18 move along the slots 19 in the extensions 20 so causing the drive member 21 to oscillate so causing the tail to move up and down and the tail fin to move in the opposite direction to the tail.

As the toy 1 moves through the water, it is buoyed up by the floatation effect of floats 23 and 24. As the toy 1 moves through the water, water enters the toy through inlets 22 in body portion 2 and emerges between the body 2 and tail 3 at X.

Figure 3:
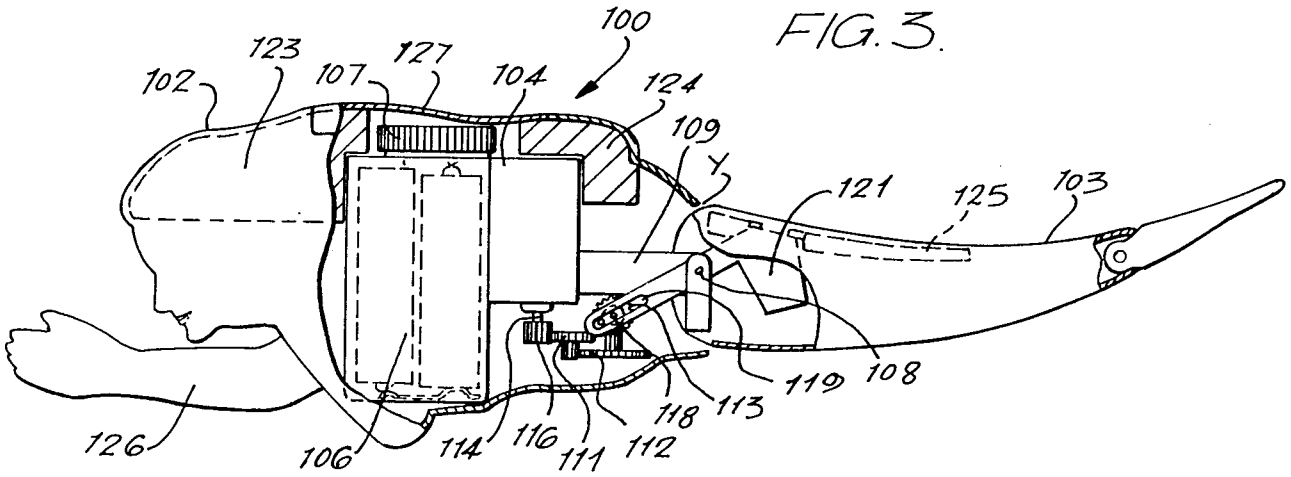
FIG. 3 is a vertical cross-section through another embodiment of a toy mermaid in accordance with the present invention.
Figure 4:
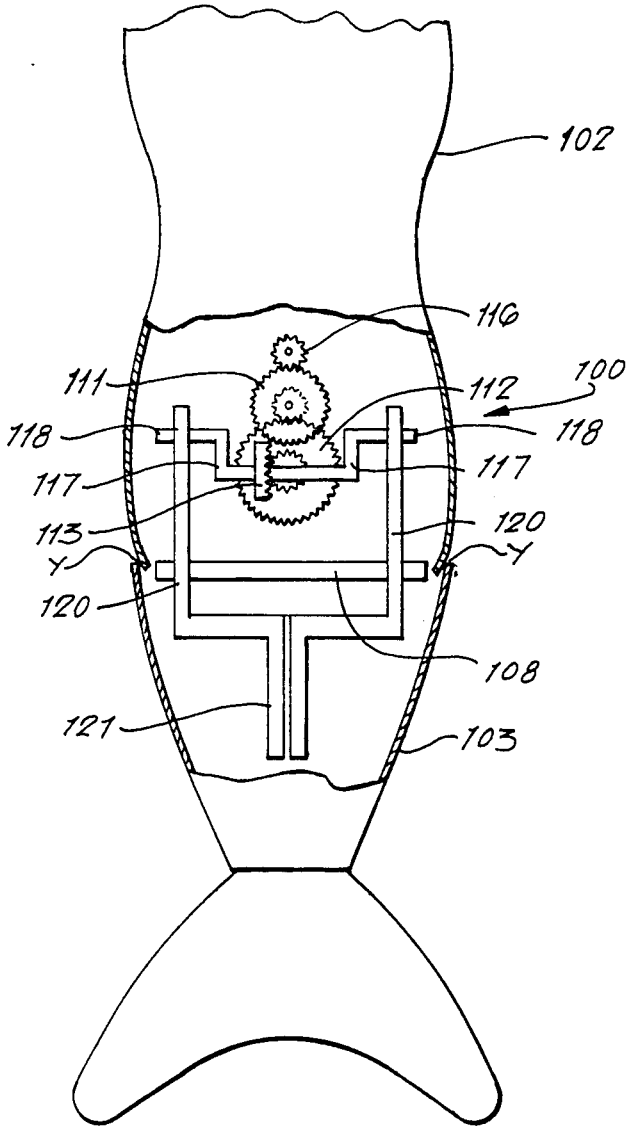
FIG. 4 is a partial plan view showing in particular the drive mechanism of the toy of FIG. 3.

The toy shown generally as 100 in FIG. 3 simulates a mermaid and comprises a body portion 102 and a tail portion 103. A motor 104 is housed in a water tight compartment within the body 102 and is powered by batteries 106 housed in a battery compartment within the body 102 and connected to the motor by a rotatable on/off switch 107 which can be operated from outside of the body 102 and makes the battery compartment water-tight when the switch is turned to the on position. The switch is covered by a lid 127 which forms part of the hair of the mermaid.

The tail 103 is pivotally mounted at 108 to an extension 109 of an internal wall (not shown) of the body portion 102 constituting a gear box.

The tail 103 is driven by the motor 104 through a drive mechanism comprising three gear wheels 111, 112 and 113 mounted in the gear box. The gear 111 is driven by a shaft 114 of the motor 104. The shaft 114 carries a pinion gear 116 which engages gear wheel 111. Gear 111 engages gear 112 which in turn engages gear 113. The spindle of gear 113 carries two crank levers 117. Each crank lever 117 has a pin 118 which engages in a slot 119 located in respective extensions 120 of a drive member 121 which is located in the tail 103. The extensions 120 are pivoted to the pivot 108.

When the motor 104 is run, the crank levers rotate and the pins 118 move along the slots 119 in the extensions 120 so causing the drive member 121 to oscillate so causing the tail to move up and down and the tail fin to move in the opposite direction to the tail.

As the toy 100 moves through the water, it is buoyed up by the floatation effect of floats 123, 124 and 125. As the toy 100 moves through the water, water enters the toy and emerges through the same gap at Y between the body 102 and tail 103.

The toy 100 is provided with arms 126, the position of which can be altered manually.

What is claimed is:

1. A toy simulating a marine creature which comprises a body portion and a tail portion with a tail fin pivotally mounted thereto; a battery operated motor housed in said body portion and arranged to move said tail and said tail fin relative to said body portion to propel said toy through the water; a drive means to drive said tail portion comprising a pair of cranks mounted parallely and directly opposite one another on a single spindle and driven through gearing by said motor; and a drive member extending down within the top portion of said tail, said drive member being provided with a pair of slots, each slot receiving a pin connected to one of said cranks.

2. A toy according to claim 1, in which said body portion has a water inlet adjacent the head of the marine creature and a water outlet between said body portion and said tail portion so that water can flow through said body as said toy moves through the water.

3. A toy according to claim 1, in which a single water inlet and outlet is provided between said body portion and said tail portion so that water can flow through said body as said toy moves through the water.

4. A toy according to claim 1, in which said motor is housed in a water-tight compartment.

5. A toy according to claim 1, in which buoyancy floats are provided in said body and tail portions.

6. A toy simulating a marine creature having a fish-like body comprising a front body portion, a tail body portion pivotally attached to the front body portion and a tail fin pivotally mounted to the tail body portion, the tail body portion and the tail fin being pivotable about substantially parallel axes; a battery operated motor housed in the front body portion;

drive means operatively coupled with the motor for pivoting the tail body portion relative to the body portion and comprising a pair of parallel cranks terminating in eccentric drive pins, and mounted opposite one another on a single spindle and driven through gearing of the drive means by said motor; and a drive member extending into the tail, pivotable relative to the front and tail body portions and provided with a pair of slots, each slot receiving one of the pins of said cranks, whereby activation of the motor with the toy in water pivots the body portion relative to each other in a first direction and causes relative pivotal movement between the tail body portion and the tail fin in a second, opposite direction.

* * * * *